US011015377B2

(12) United States Patent
Jager et al.

(10) Patent No.: US 11,015,377 B2
(45) Date of Patent: May 25, 2021

(54) HINGE ASSEMBLY

(71) Applicant: WHIRLPOOL CORPORATION, Benton Harbor, MI (US)

(72) Inventors: Sergio Ricardo Jager, Rio Claro (BR); Eduardo Sant'Anna Martins, Joinville (BR); Ledimara Mascarello, Joinville (BR)

(73) Assignee: Whirlpool Corporation, Benton Harbor, MI (US)

( * ) Notice: Subject to any disclaimer, the term of this patent is extended or adjusted under 35 U.S.C. 154(b) by 0 days.

(21) Appl. No.: 16/550,911

(22) Filed: Aug. 26, 2019

(65) Prior Publication Data

US 2021/0062560 A1 Mar. 4, 2021

(51) Int. Cl.
*E05D 3/06* (2006.01)
*E05D 7/04* (2006.01)

(52) U.S. Cl.
CPC ..... *E05D 3/06* (2013.01); *E05D 7/04* (2013.01); *E05Y 2900/308* (2013.01); *E05Y 2900/31* (2013.01); *E05Y 2900/312* (2013.01)

(58) Field of Classification Search
CPC . Y10T 16/552; Y10T 16/5525; Y10T 16/539; Y10T 16/5398; E05D 7/08; E05D 7/04; E05D 3/06; E05D 7/081; E05D 2005/102; E05D 3/02; E05F 1/063; E05Y 2900/308; E05Y 2900/31; E05Y 2900/312; F25D 2323/024
USPC ..... 312/326, 329, 405
See application file for complete search history.

(56) References Cited

U.S. PATENT DOCUMENTS 3,604,154 A * 9/1971 Curran ..... E05D 7/081 49/501
5,265,954 A * 11/1993 Keil ..... E05D 11/00 16/358
5,369,842 A * 12/1994 Beatty ..... E05F 1/063 16/317
5,788,351 A 8/1998 Prunty et al.
6,030,064 A * 2/2000 Kim ..... E05D 7/0423 312/405

(Continued)

FOREIGN PATENT DOCUMENTS

DE 102008028756 * 7/2009
FR 2626968 * 8/1989
GB 2215761 * 9/1989

OTHER PUBLICATIONS

KR 2017127605 Hyung abstract and figure (Year: 2017).*

*Primary Examiner* — Janet M Wilkens
(74) *Attorney, Agent, or Firm* — Price Heneveld LLP

(57) ABSTRACT

An appliance includes a door coupled with a front panel of a cabinet that defines an upper pin slot. A top panel of the cabinet is configured to extend over the door when the door is closed. An upper hinge assembly includes an upper hinge pin configured to be rotatably received by the upper pin slot of the door. A fixed bracket has a first portion coupled with the front panel of the cabinet and a second portion that extends perpendicular to the first portion. The second portion defines an opening configured to receive the upper hinge pin. A rotating bracket is coupled with the upper hinge pin and is movable between first and second positions. The rotating bracket is configured to be fixedly coupled with the second portion of the fixed bracket when the rotating bracket is in the second position.

18 Claims, 10 Drawing Sheets

(56) References Cited

U.S. PATENT DOCUMENTS

| | | | | |
|---|---|---|---|---|
| 6,128,807 | A | 10/2000 | Lim et al. | |
| 8,506,026 | B2 | 8/2013 | Kim et al. | |
| 8,511,768 | B2 | 8/2013 | Brachert | |
| 9,534,433 | B2 | 1/2017 | Elkasevic et al. | |
| 2003/0151339 | A1* | 8/2003 | Reed | E05D 11/1078 312/405 |
| 2004/0237257 | A1* | 12/2004 | Pohl | E05D 7/081 16/221 |
| 2005/0188506 | A1* | 9/2005 | Lee | E05D 7/081 16/376 |
| 2010/0127514 | A1* | 5/2010 | Nilsson | E05D 7/081 292/252 |
| 2013/0067688 | A1* | 3/2013 | Kim | E05D 11/06 163/319 |
| 2015/0145400 | A1 | 5/2015 | Lee et al. | |
| 2017/0167173 | A1* | 6/2017 | Johnson | E05D 11/0081 |
| 2018/0202706 | A1* | 7/2018 | Lee | F25D 23/028 |

* cited by examiner

HINGE ASSEMBLY

FIELD OF DISCLOSURE

The present disclosure generally relates to a hinge assembly, and more specifically, to a hinge assembly for an appliance door.

BACKGROUND

Hinge assemblies are used on appliances to couple doors with cabinets. Often these hinge assemblies are specific to a particular appliance and are not readily usable with multiple doors and/or cabinets. A hinge assembly that accounts for variations in doors and cabinets and can be used across various appliances is described herein.

SUMMARY OF THE DISCLOSURE

According to one aspect of the present disclosure, an appliance includes a door that is coupled with a front panel of a cabinet and defines an upper pin slot. A top panel of the cabinet is configured to extend over the door when the door is closed. An upper hinge assembly includes an upper hinge pin configured to be rotatably received by the upper pin slot of the door. A fixed bracket has a first portion coupled with the front panel of the cabinet and a second portion that extends perpendicular to the first portion. The second portion defines an opening configured to receive the upper hinge pin. A rotating bracket is coupled with the upper hinge pin and is movable between first and second positions. The rotating bracket is configured to be fixedly coupled with the second portion of the fixed bracket when the rotating bracket is in the second position.

According to another aspect of the present disclosure, an appliance includes a cabinet that has a front panel and a door that has a top side and a bottom side. The top side defines an upper pin slot. A top panel is coupled with the cabinet and is configured to extend over an upper hinge assembly. The upper hinge assembly includes an upper hinge pin configured to be rotatably received by the upper pin slot of the door. A fixed bracket has a first portion that is coupled with the front panel of the cabinet and a second portion that defines an opening configured to receive the upper hinge pin. A rotating bracket is coupled with the upper hinge pin and is movable between first and second positions. The rotating bracket is aligned with and coupled with the second portion of the fixed bracket when the rotating bracket is in the second position.

According to yet another aspect of the present disclosure, a hinge assembly for an appliance includes a hinge pin configured to be rotatably received by a pin slot of a door and a fixed bracket that has a first portion and a second portion. The first portion is coupled with a cabinet. The second portion extends perpendicular to the first portion and defines an opening configured to receive the hinge pin. A rotating bracket is coupled with the hinge pin and is movable between first and second positions. The rotating bracket is configured to be fixedly coupled with the second portion of the fixed bracket when the rotating bracket is in the second position.

These and other features, advantages, and objects of the present disclosure will be further understood and appreciated by those skilled in the art by reference to the following specification, claims, and appended drawings.

Figure 1:
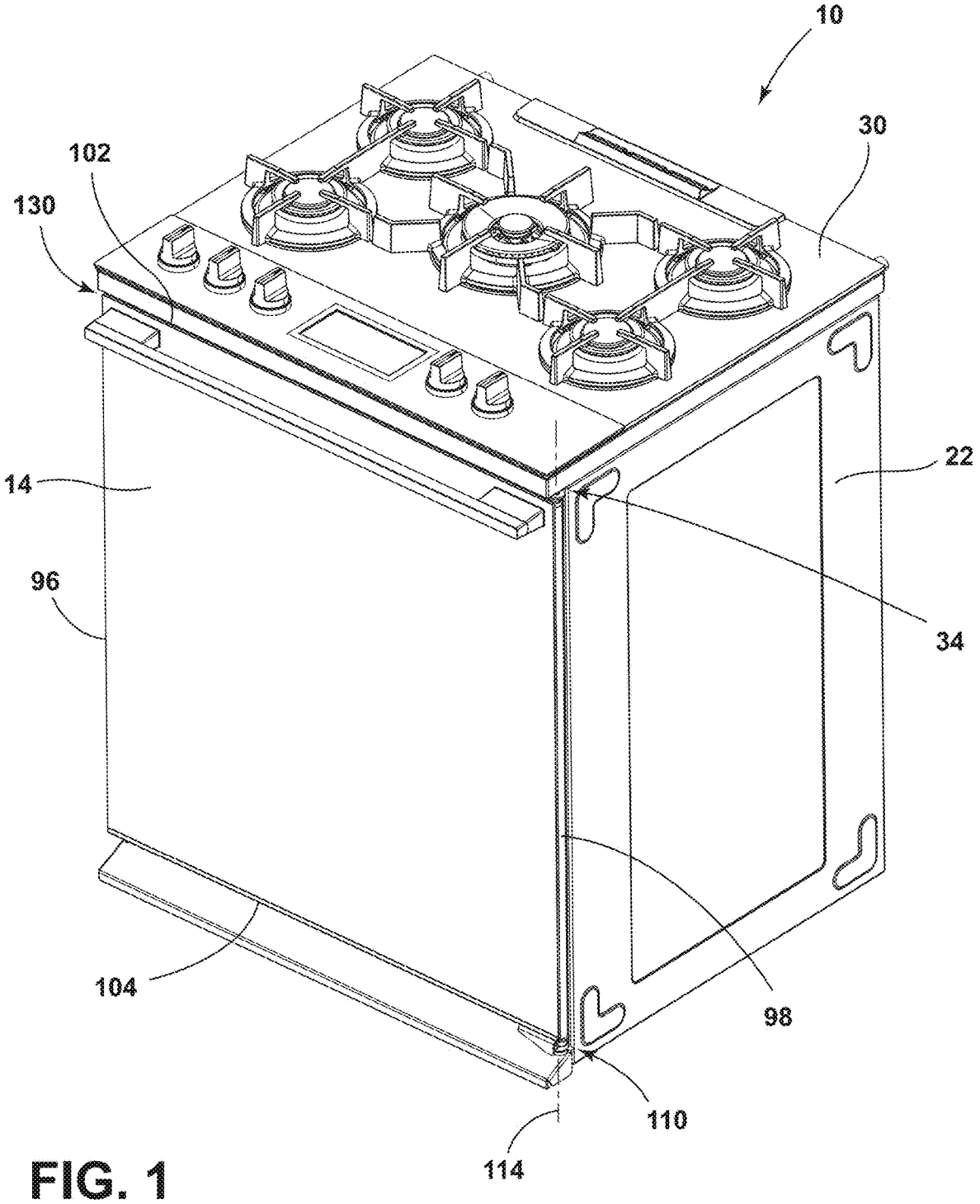
FIG. 1 is a first side perspective view of an appliance, according to various examples.

The components in the figures are not necessarily to scale, emphasis instead being placed upon illustrating the principles described herein.

DETAILED DESCRIPTION

The present illustrated embodiments reside primarily in combinations of method steps and apparatus components related to a hinge assembly for an appliance. Accordingly, the apparatus components and method steps have been represented, where appropriate, by conventional symbols in the drawings, showing only those specific details that are pertinent to understanding the embodiments of the present disclosure so as not to obscure the disclosure with details that will be readily apparent to those of ordinary skill in the art having the benefit of the description herein. Further, like numerals in the description and drawings represent like elements.

For purposes of description herein, the terms "upper," "lower," "right," "left," "rear," "front," "vertical," "horizontal," and derivatives thereof shall relate to the disclosure as oriented in FIG. 1. Unless stated otherwise, the term "front" shall refer to the surface of the element closer to an intended viewer, and the term "rear" shall refer to the surface of the element further from the intended viewer. However, it is to be understood that the disclosure may assume various alternative orientations, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

The terms "including," "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus. An element proceeded by "comprises a . . . " does not, without more constraints, preclude the existence of additional identical elements in the process, method, article, or apparatus that comprises the element.

Referring to FIGS. 1-10, reference numeral 10 generally designates an appliance that includes a door 14 that is coupled with a front panel 18 of a cabinet 22 and defines an upper pin slot 26. A top panel 30 of the cabinet 22 is configured to extend over the door 14 when the door 14 is closed. An upper hinge assembly 34 includes an upper hinge pin 38. The upper hinge pin 38 is configured to be rotatably received by the upper pin slot 26 of the door 14. A fixed bracket 42 has a first portion 46 and a second portion 50. The first portion 46 is coupled with the front panel 18 of the cabinet 22. The second portion 50 extends perpendicular to the first portion 46 and defines a receiving well 54. The second portion 50 also defines an opening 58 configured to receive the upper hinge pin 38. A rotating bracket 62 is coupled with the upper hinge pin 38 and is movable between first and second positions. The rotating bracket 62 is configured to be fixedly coupled with the second portion 50 of the fixed bracket 42 when the rotating bracket 62 is in the second position.

While aspects of the present disclosure are discussed and illustrated in the context of a cooking oven, it is contemplated that the hinge assembly 34 may be used in a variety of appliances including, for example, a microwave oven, a refrigerator, a freezer, and a laundry treating appliance, such as a clothes dryer or clothes washer. When the appliance 10 is in the form of a cooking oven, the cabinet 22 may be a housing that includes a chassis and/or frame which defines the interior and which encloses components typically found in a conventional cooking oven, such as electrical components, heating elements, gas lines, valves, control units, burner elements, broiler elements, and the like. Such components will not be described further herein except where necessary for a complete understanding of the aspects of the present disclosure.

Figure 2:
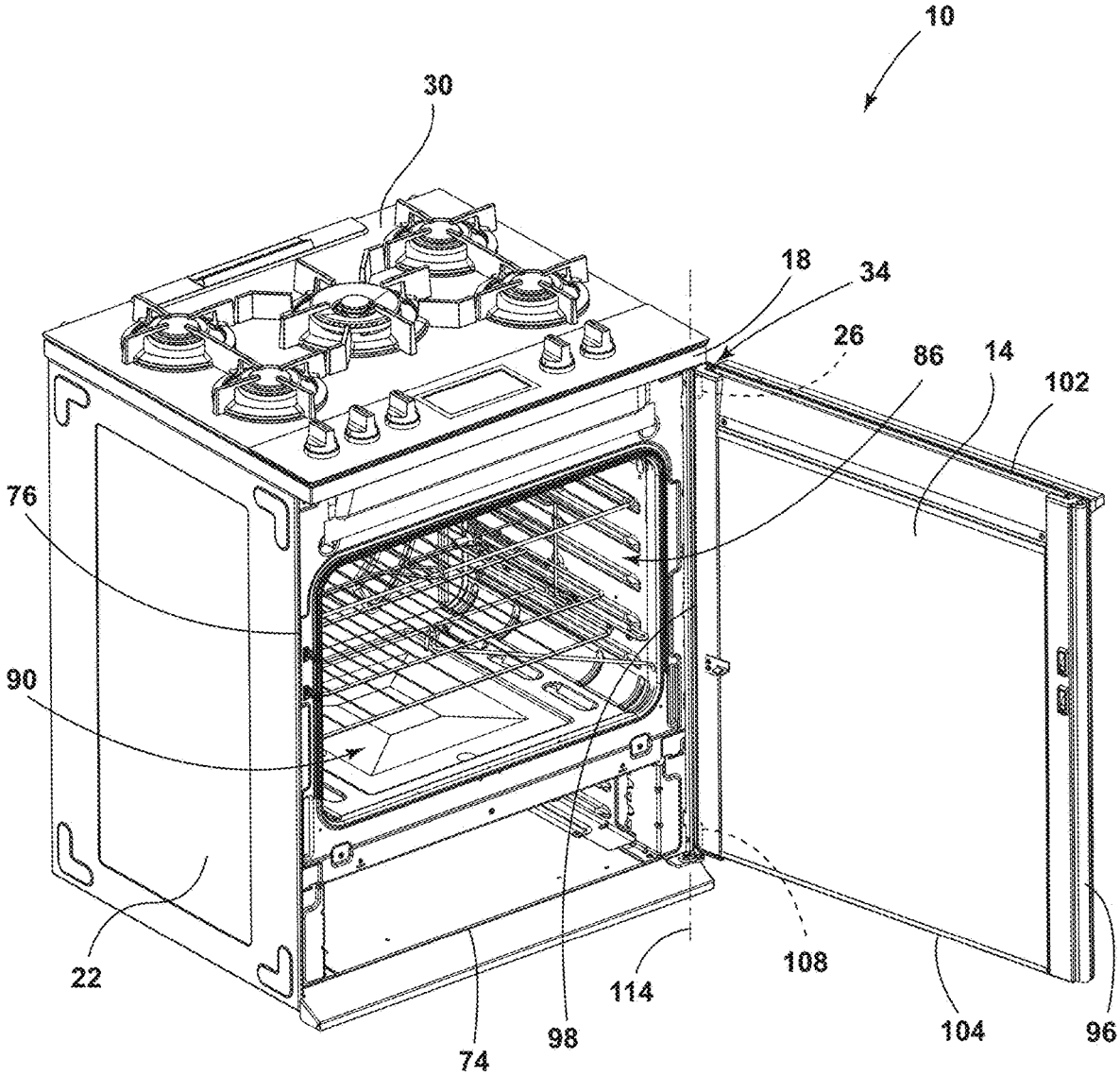
FIG. 2 is a second side perspective view of the appliance of FIG. 1 with a door in an open position.
Figure 3:
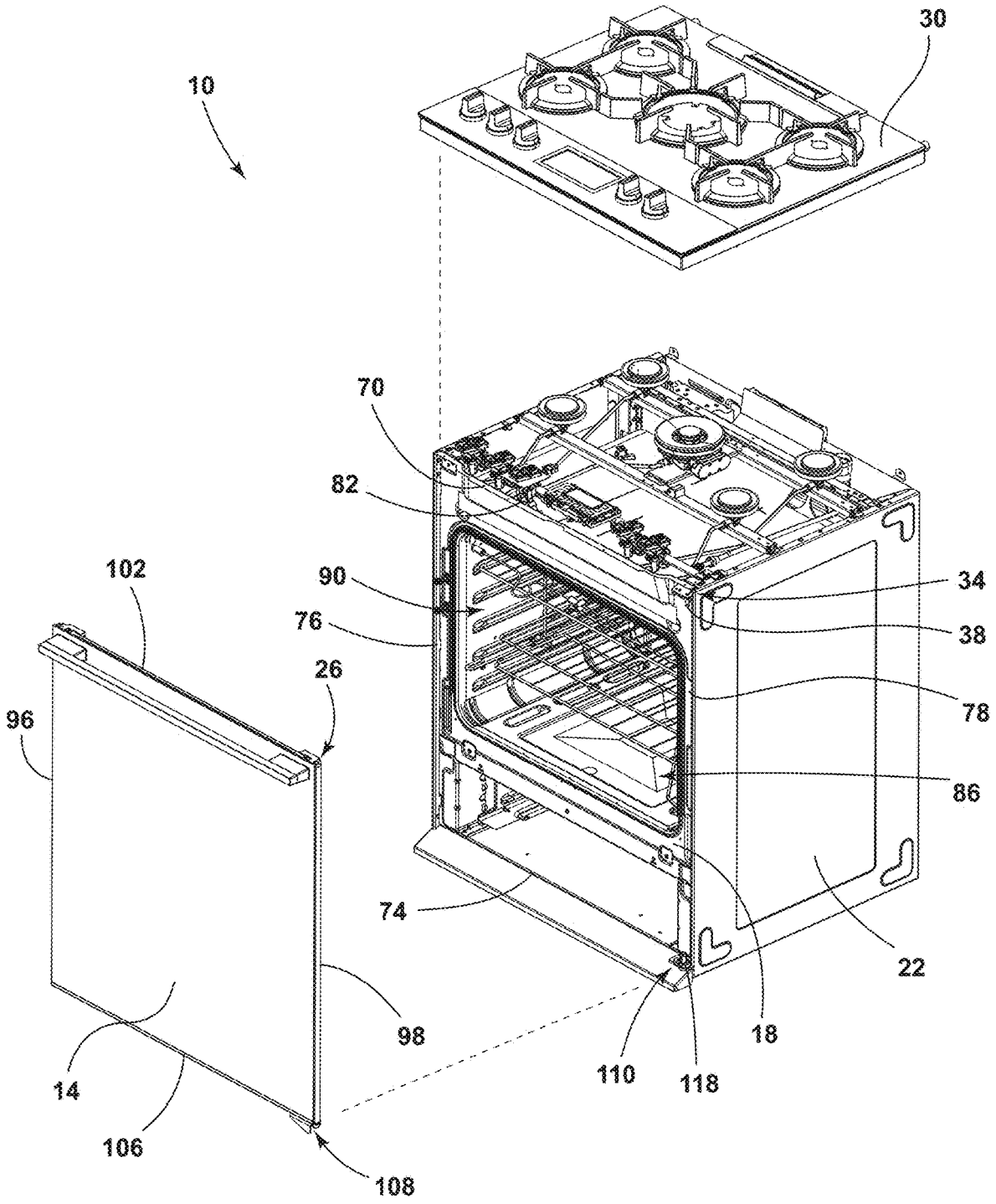
FIG. 3 is an exploded first side perspective view of a cabinet of the appliance of FIG. 1 that includes an upper hinge assembly and a lower hinge assembly, with a door and a cooktop separated from the cabinet.

Referring to FIGS. 1-3, the appliance 10 includes the cabinet 22 that defines an interior and includes the front panel 18. The front panel 18 of the cabinet 22 includes a top edge 70 and a bottom edge 74 that extends between first and second lateral edges 76, 78. A lip 82 may extend from the top edge 70 of the front panel 18 and may be configured to at least partially support the top panel 30 when the appliance 10 is assembled. The front panel 18 defines an access opening 86 to a chamber 90 disposed within the interior of the cabinet 22. The chamber 90 may be a cooking chamber 90 with gas and/or electric heating elements that may be provided within the cabinet 22 for providing heat to the cooking chamber 90 during a cooking cycle.

The door 14 has a perimeter formed by first and second lateral sides 96, 98 joined by a top side 102 and a bottom side 106. The door 14 is hingedly coupled with the cabinet 22 by the upper hinge assembly 34 and a lower hinge assembly 110, as discussed in more detail elsewhere herein. Together, the upper and lower hinge assemblies 34, 110 define a vertical axis 114 that extends between the upper hinge pin 38 and a lower hinge pin 118. The vertical axis 114 is defined proximate and parallel to one of the first and second lateral edges 76, 78 of the front panel 18. The door 14 is rotatable about the vertical axis 114 and is configured to selectively close the access opening 86 of the chamber 90. When the door 14 is closed, the first and second lateral sides 96, 98 align with the first and second lateral edges 76, 78 of the front panel 18, respectively. Likewise, the top and bottom sides 102, 106 are substantially aligned with the top and bottom edges 70, 74 of the front panel 18.

Referring still to FIGS. 1-3, the top side 102 of the door 14 defines the upper pin slot 26. For example, the top side 102 may be a single member that extends along the top of the door 14 to define the upper pin slot 26. Alternatively, the top side 102 may include a plurality of upper surface components of the door 14 (e.g., a center panel and a side member) where the upper pin slot 26 is defined by any one of the components of the door 14 that form the top side 102 of the door 14. The upper pin slot 26 extends from the top side 102 of the door 14 into an interior of the door 14.

Likewise, the bottom side 106 of the door 14 defines a lower pin slot 108 that is vertically aligned with the upper pin slot 26. The bottom side 106 of the door 14 may be a single member that extends along the bottom of the door 14 to define the lower pin slot 108. Alternatively, the bottom side 106 may include a plurality of lower surface components of the door 14 (e.g., a center panel and a side member) where the lower pin slot 108 is defined by any one of the components of the door 14 that form the bottom side 106 of the door 14. The lower pin slot 108 extends from the bottom side 106 of the door 14 into the interior of the door 14. In various examples, each of the upper and lower pin slots 26, 108 may be enclosed and separated from the interior of the door 14. In other examples, the upper pin slot 26 may be in communication with the lower pin slot 108, such that the upper and lower pin slots 26, 108 extend through the door 14 as a single continuous slot. In still other examples, each of the upper and lower pin slots 26, 108 may extend through the respective sides 102, 106 of the door 14 and may be in communication with the interior of the door 14.

As illustrated in FIGS. 1-3, where the appliance 10 is a cooking oven, the top panel 30 may be a cooktop, and is referenced as such herein. It will be understood that the cooktop 30 may include one or more burner elements and/or actuators, the specific design of which is not relative to the aspects of the present disclosure, and which may vary depending on the type of home appliance. For example, the cooktop 30 may be a gas-powered cooktop where the burner elements are configured to provide a heat source by burning a gas fuel source, or the cooktop 30 may be an electric powered cooktop where the burner elements include resistive heating elements that are powered by a flow of electricity thereto.

When the cooktop 30 is coupled with the cabinet 22, the cooktop 30 is supported by the cabinet 22 and may extend over or to the edge of the lip 82. In some examples, the cooktop 30 may be coupled with the lip 82 of the front panel 18. In other examples, the cooktop 30 may be coupled with the upper hinge assembly 34, or other features of the appliance 10. As illustrated in FIGS. 1 and 2, the cooktop 30 is positioned so that when the door 14 is closed, the cooktop 30 extends at least partially over the top side 102 of the door 14 and the upper hinge assembly 34, such that a gap 130 is defined between the door 14 and the cooktop 30.

Figure 4:
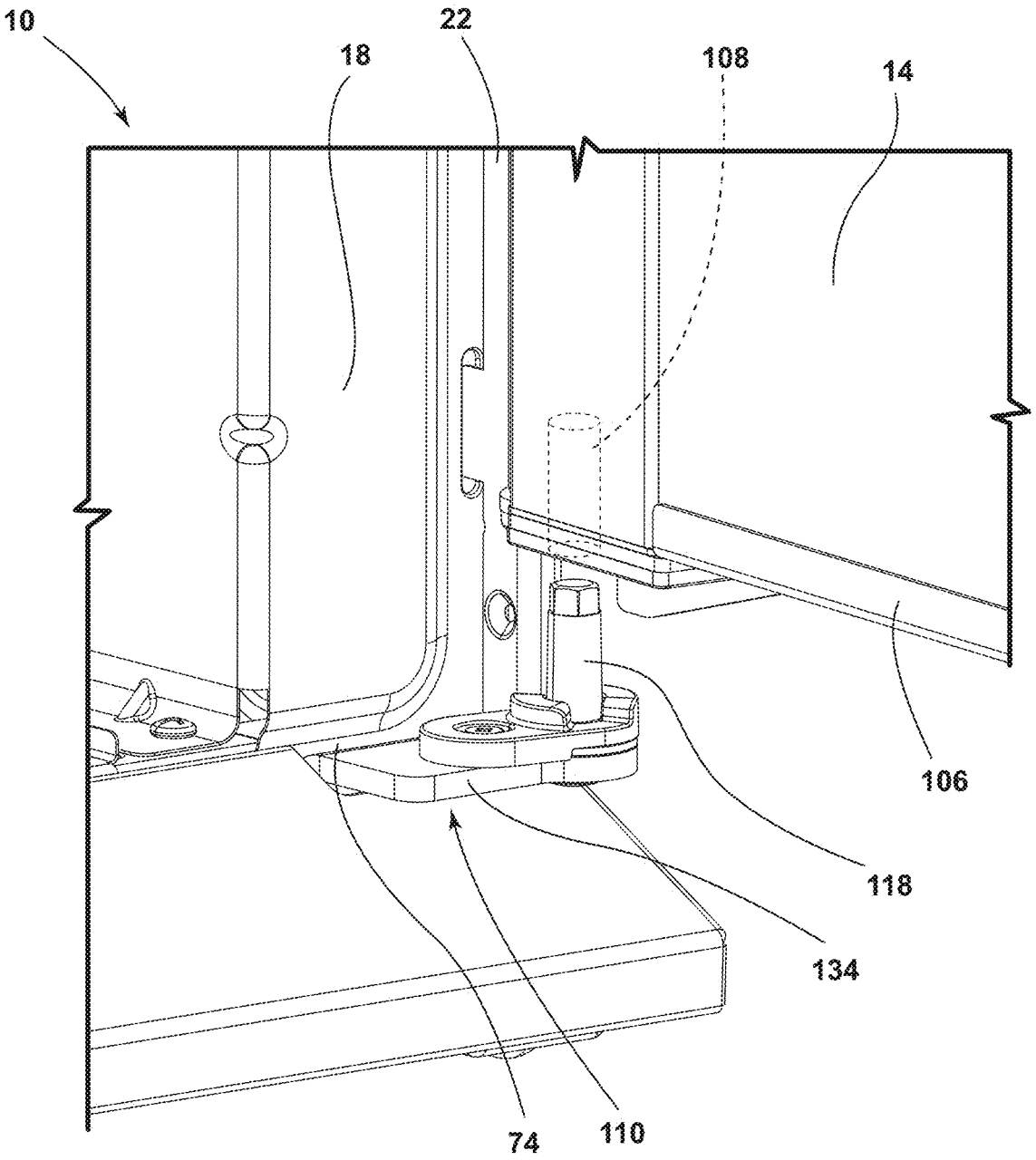
FIG. 4 is an enlarged partial perspective view of the lower hinge assembly of FIG. 3.

Referring now to FIG. 3, the upper and lower hinge assemblies 34, 110 are shown coupled with the cabinet 22 with the door 14 removed. As illustrated in FIGS. 3 and 4, the lower hinge assembly 110 includes a lower plate 134 that extends from the bottom edge 74 of the front panel 18. A lower hinge pin 118 extends upward from the lower plate 134 and is configured to be received by the lower pin slot 108 of the door 14. It will be understood that the lower hinge assembly 110 may be any hinge assembly that allows the lower hinge pin 118 to couple the door 14 to the cabinet 22.

Figure 5:
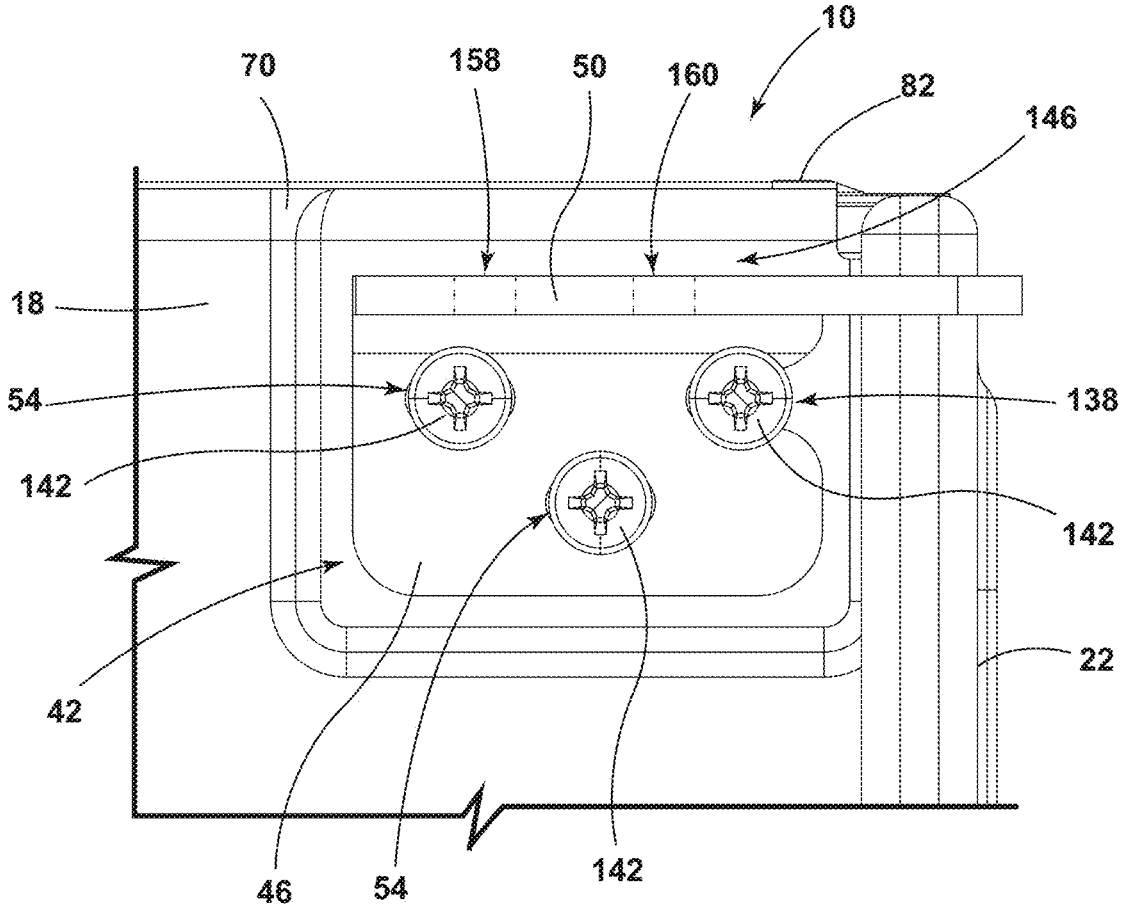
FIG. 5 is an enlarged front elevational view of a first bracket of the upper hinge assembly of FIG. 3.
Figure 6:
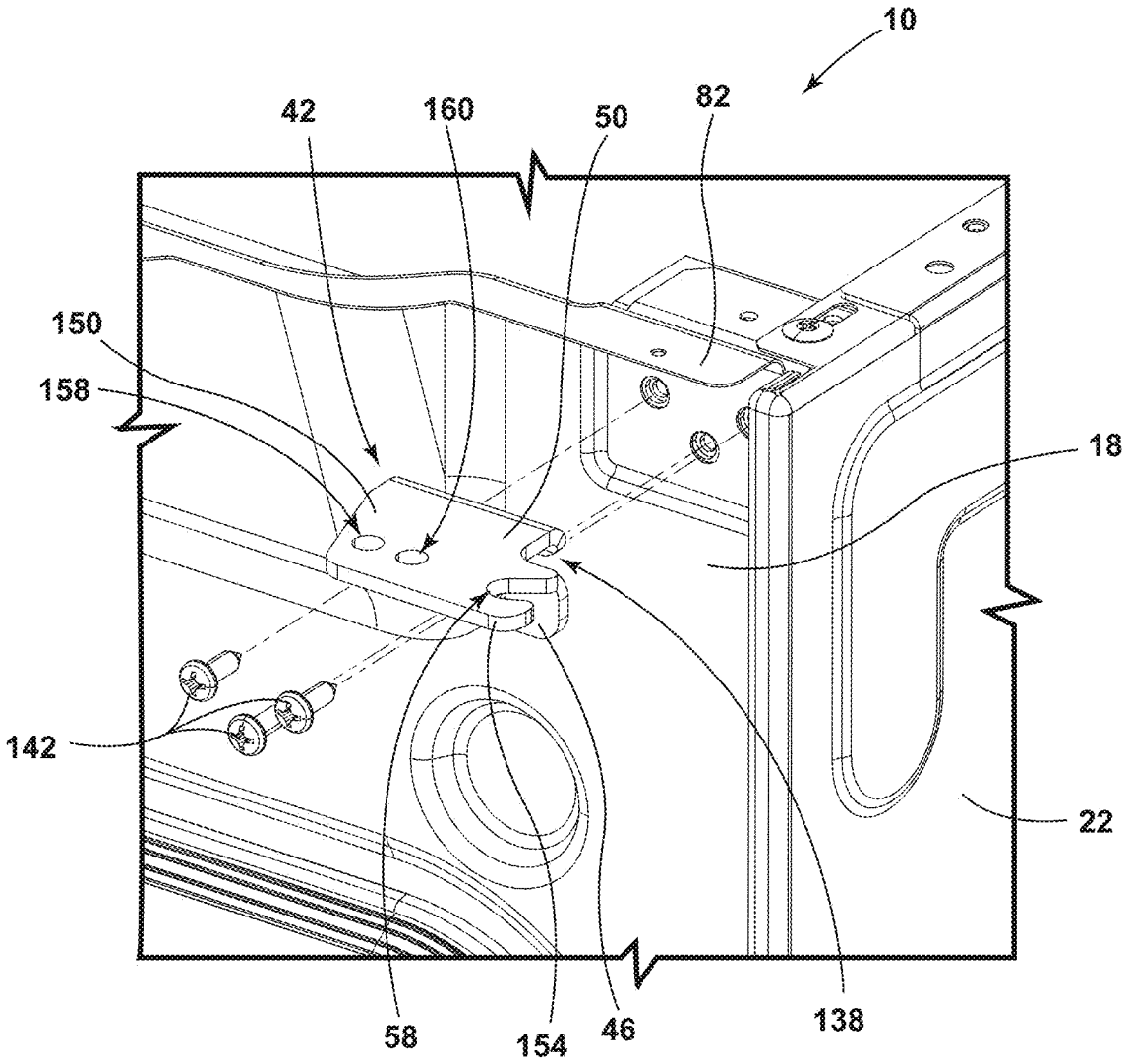
FIG. 6 is an enlarged exploded top perspective view of a first bracket of the upper hinge assembly of FIG. 3 separated from a cabinet of the appliance.
Figure 7:
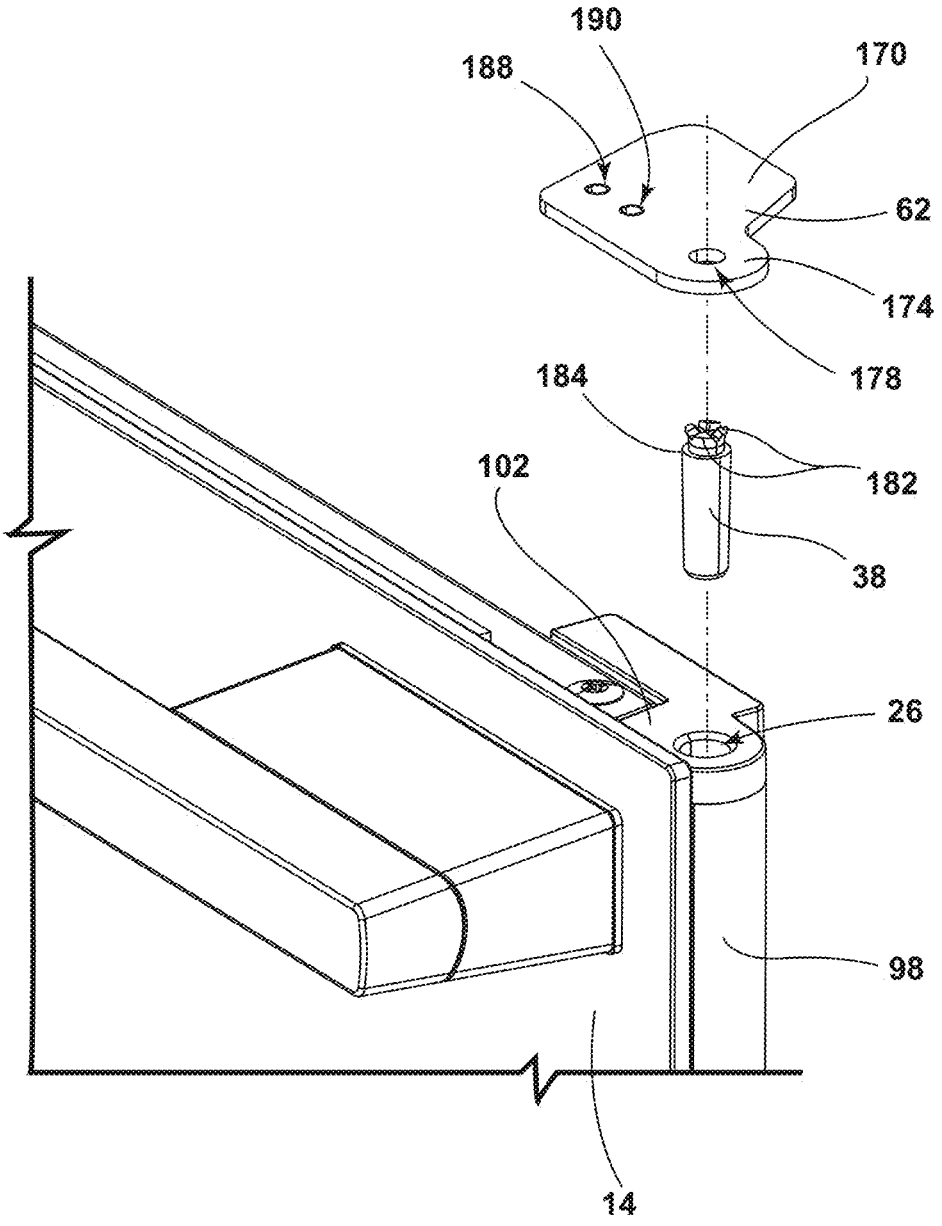
FIG. 7 is an enlarged exploded front perspective view of a second bracket of the upper hinge assembly of FIG. 3 separated from the door of the appliance.
Figure 8:
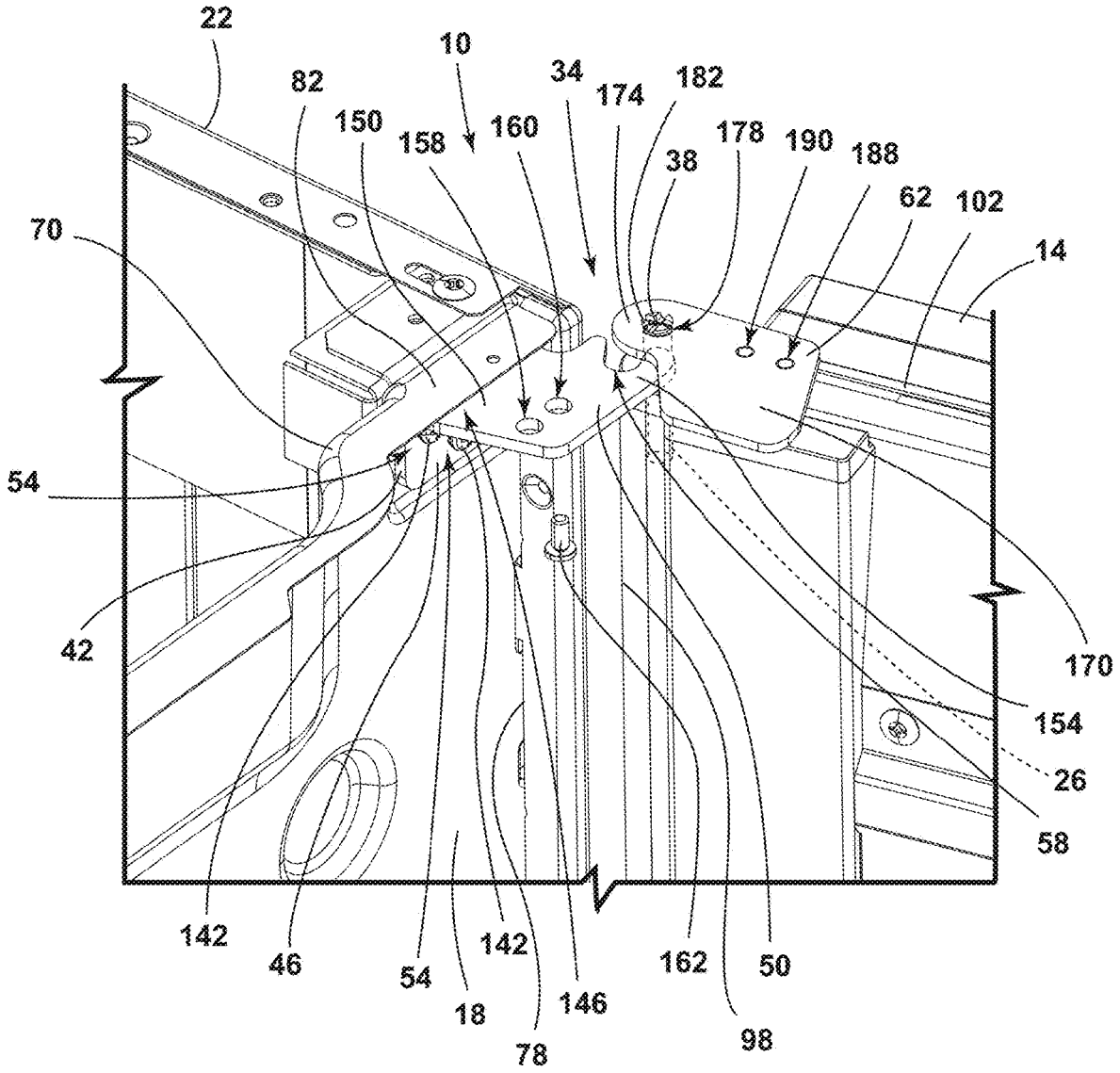
FIG. 8 is an enlarged partial top perspective view of an appliance with a bracket of an upper hinge assembly in a first position, according to various examples.

Referring now to FIGS. 5-8, the upper hinge assembly 34 includes the fixed bracket 42 coupled with the front panel 18 of the appliance 10 (FIGS. 5 and 6) and the rotating bracket 62 coupled with the upper hinge pin 38 (FIG. 7). As discussed in more detail elsewhere herein, the rotating bracket 62 may be coupled with the fixed bracket 42 to couple the door 14 with the cabinet 22 of the appliance 10 (FIG. 8).

As illustrated in FIGS. 5 and 6, the fixed bracket 42 includes the first and second portions 46, 50. The first portion 46 is substantially planar and is positioned flush with the front panel 18 of the cabinet 22. The first portion 46 defines the receiving well 54. The receiving well 54 may be one of a plurality of receiving wells 54. Each receiving well 54 of the plurality of receiving wells 54 may have a horizontally-extending, elongated shape. For example, each of the receiving wells 54 may have a substantially obround shape, as illustrated in FIG. 5. Alternatively, each of the receiving wells 54 may have a rectangular shape, an oblong shape, or any other elongated shape. The plurality of receiving wells 54 may have any number of receiving wells 54 without departing from the scope of the present disclosure. In various examples, the first portion 46 of the fixed bracket 42 may further define a cutout 138 that extends from a lateral edge of the first portion 46. The cutout 138 may be elongated to have a shape similar to the shape of each of the plurality of receiving wells 54. The cutout 138 is defined proximate the plurality of receiving wells 54. It is contemplated that the cutout 138 may be replaced with an additional receiving well 54 of the plurality of receiving wells 54.

Each of the plurality of receiving wells 54 and the cutout 138 may be configured to receive one of a plurality of bracket fasteners 142. Each of the plurality of bracket fasteners 142 may be any fastener including, for example, a screw or a bolt. The plurality of bracket fasteners 142 are configured to couple the first portion 46 of the fixed bracket 42 with the front panel 18 of the cabinet 22 when the plurality of bracket fasteners 142 are received by the plurality of receiving wells 54.

As further illustrated in FIGS. 5 and 6, the second portion 50 of the fixed bracket 42 extends perpendicularly from the first portion 46 of the fixed bracket 42. When the first portion 46 is coupled with the front panel 18 of the appliance 10, the second portion 50 is spaced apart from the lip 82 of the front panel 18 to define a receiving space 146.

The second portion 50 includes a body 150 and an arm 154. The arm 154 extends from the body 150 and defines the opening 58. The opening 58 has a size and shape configured to receive the upper hinge pin 38. The body 150 of the second portion 50 defines first and second lower apertures 158, 160. The first and second lower apertures 158, 160 may be positioned proximate a front edge of the second portion 50. The second lower aperture 160 is configured to receive a hinge fastener 162 (FIG. 8), as described elsewhere herein. It is contemplated that the second portion 50 may define a single lower aperture 160 configured to receive the hinge fastener 162 (FIG. 8), without departing the scope of the present disclosure.

Referring now to FIG. 7, the rotating bracket 62 includes a body 170 and a protrusion 174. The protrusion 174 may define a connection opening 178 configured to receive the upper hinge pin 38. The body 170 and the protrusion 174 of the rotating bracket 62 are shaped to complement the body 150 and the arm 154 of the second portion 50 of the fixed bracket 42 (FIG. 6).

The rotating bracket 62 is fixedly coupled with the upper hinge pin 38. For example, the upper hinge pin 38 may include a plurality of prongs 182 that extend from a top end 184 of the upper hinge pin 38. The connection opening 178 of the rotating bracket 62 may be configured to receive the plurality of prongs 182 of the upper hinge pin 38. The plurality of prongs 182 may be tightened to fixedly couple the rotating bracket 62 with the top end 184 of the upper hinge pin 38. It will be understood that any method of coupling the upper hinge pin 38 with the rotating bracket 62 may be used in place of, or in conjunction with, the plurality of prongs 182. Alternatively, the rotating bracket 62 may be integrally formed with the upper hinge pin 38. When the rotating bracket 62 is fixedly coupled with the upper hinge pin 38, the rotating bracket 62 is rotatable in conjunction with the upper hinge pin 38 and is movable between the first position and the second position.

The body 170 of the rotating bracket 62 defines first and second upper apertures 188, 190. The first and second upper apertures 188, 190 are configured to be aligned with the first and second lower apertures 158, 160, respectively, when the rotating bracket 62 is aligned with the second portion 50 of the fixed bracket 42. The second upper aperture 190 is configured to receive the hinge fastener 162 when the rotating bracket 62 is in the second position and the hinge fastener 162 is received by the second lower aperture 160. It is contemplated that the rotating bracket 62 may define a single upper aperture, configured to align with a single lower aperture, and receive the hinge fastener 162 without departing from the scope of the present disclosure.

Figure 9:
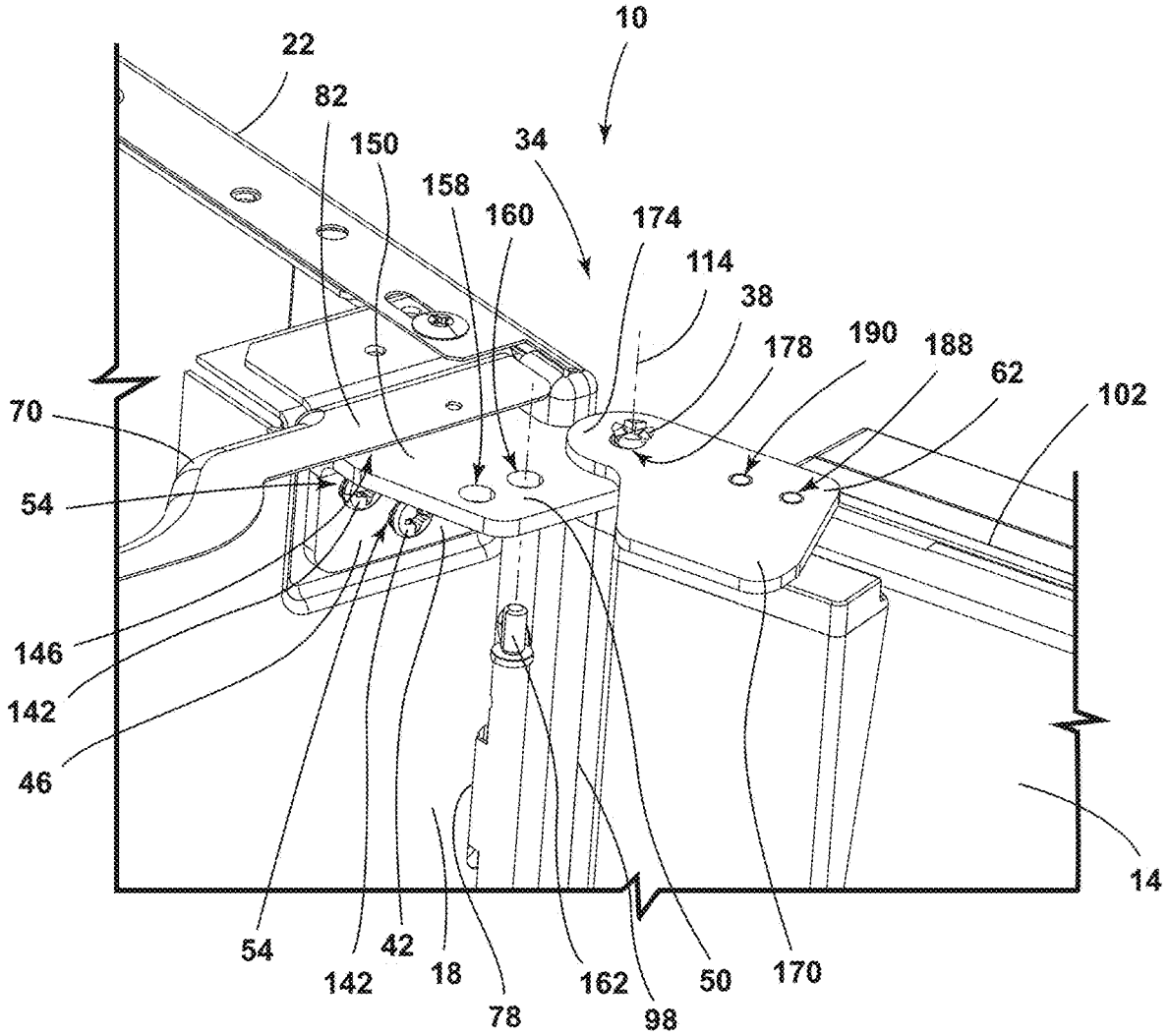
FIG. 9 is an enlarged partial top perspective view of the appliance of FIG. 8 with the bracket of the upper hinge assembly between the first position and a second position.
Figure 10:
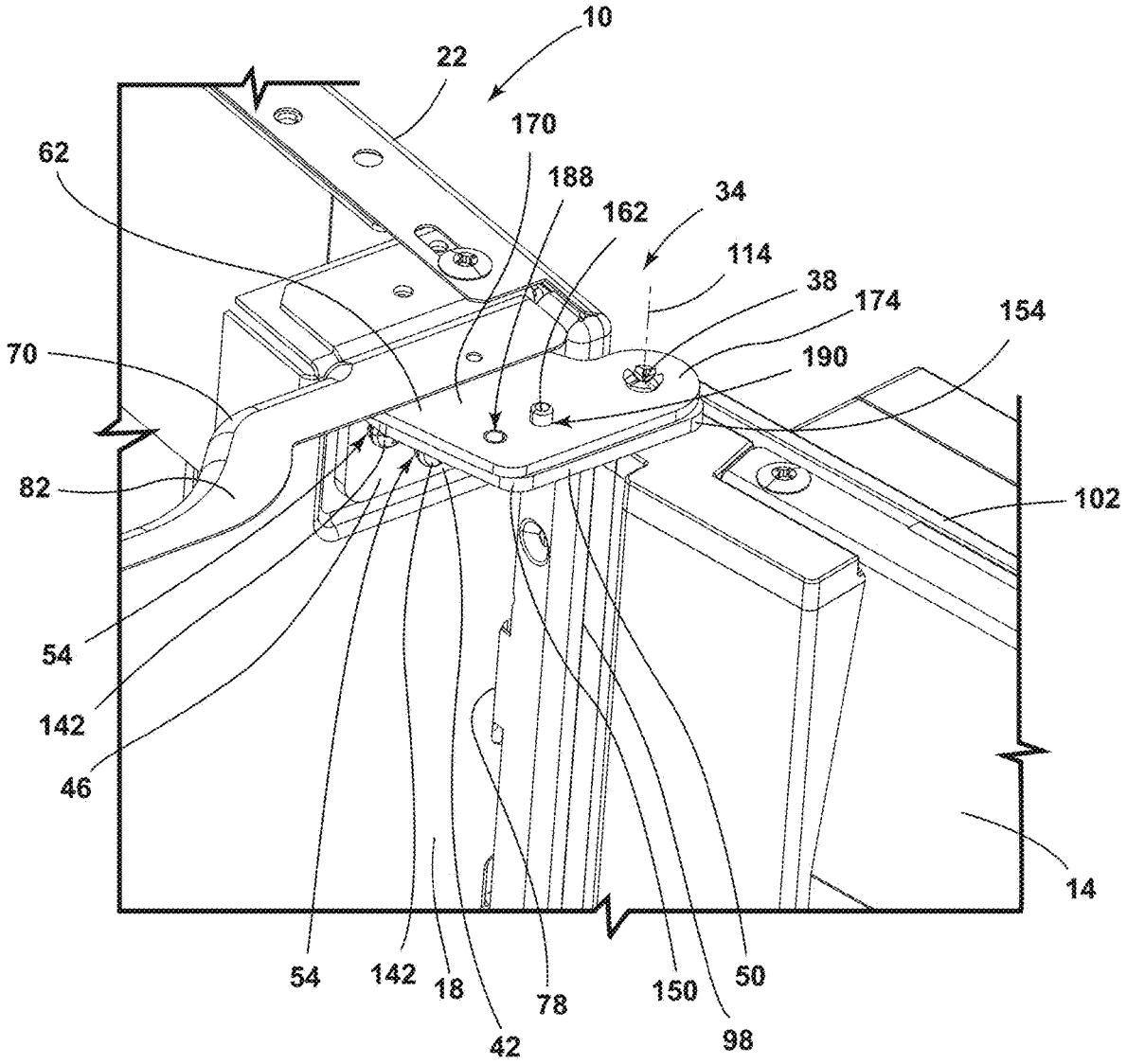
FIG. 10 is an enlarged partial top perspective view of the appliance of FIG. 8 with the bracket of the upper hinge assembly in a second position.

Referring now to FIGS. 8-10, in assembly, the first portion 46 of the fixed bracket 42 is positioned flush with the front panel 18 of the cabinet 22, such that the second portion 50 extends perpendicular to the front panel 18. The arm 154 of the second portion 50 extends outward of the front panel 18 toward one of the first and second lateral edges 76, 78 of the front panel 18. Each of the plurality of bracket fasteners 142 is positioned through the respective receiving well 54 of the plurality of receiving wells 54 and/or the cutout 138. The plurality of bracket fasteners 142 are partially tightened to couple the fixed bracket 42 with the front panel 18 of the cabinet 22. The fixed bracket 42 is horizontally adjusted to accommodate any horizontal variation of the cabinet 22 and/or the door 14 of the appliance 10. When the fixed bracket 42 is properly aligned, the plurality of bracket fasteners 142 are tightened to fixedly couple the fixed bracket 42 with the front panel 18.

The upper hinge pin 38 may be fixedly coupled with the rotating bracket 62. For example, the plurality of prongs 182 may be received by the connection opening 178 and may be subsequently tightened. In other examples, adhesive, welding, or any other method of fixedly coupling the rotating bracket 62 with the upper hinge pin 38 may be used.

The door 14 is positioned so that the lower hinge pin 118 is aligned with the lower pin slot 108. The door 14 is lowered until the lower hinge pin 118 is fully received within the lower pin slot 108. The upper hinge pin 38 may be inserted into the upper pin slot 26 defined by the door 14.

The door 14 is rotated upward into alignment with the cabinet 22. The fixed bracket 42 is horizontally adjusted to accommodate any horizontal variation of the cabinet 22 and/or the door 14 of the appliance 10. When the fixed bracket 42 has been adjusted, the second portion 50 of the fixed bracket 42 is positioned to align with the rotating bracket 62 when the rotating bracket 62 is in the second position. Further, the first and second lateral sides 96, 98 of the door 14 are positioned to align with the first and second lateral edges 76, 78 of the front panel 18, respectively, when the door 14 is closed. When the fixed bracket 42 is positioned to result in the disclosed alignment of the door 14 with the front panel 18, the plurality of bracket fasteners 142 are tightened to fixedly couple the fixed bracket 42 with the front panel 18. Additionally, the upper hinge pin 38 is vertically translatable within the upper pin slot 26 to accommodate for any vertical variation of the cabinet 22 and/or the door 14. The upper hinge pin 38 may be adjusted vertically so that the top and bottom sides 102, 106 of the door 14 are positioned to align with the top and bottom edges 70, 74 of the front panel 18, respectively, and the rotating bracket 62 is positioned to be received by the receiving space 146.

The door 14 is moved into alignment with the cabinet 22, such that the upper hinge pin 38 is received by the opening 58 of the second portion 50 of the fixed bracket 42. When the upper hinge pin 38 is received by the opening 58, the upper hinge pin 38 is rotatable within the opening 58 of the second portion 50 of the fixed bracket 42, and within the upper pin slot 26. As the upper hinge pin 38 is rotated, the rotating bracket 62 is simultaneously rotated. The rotating bracket 62 rotates from the first position (FIG. 9) to the second position (FIG. 10). When the rotating bracket 62 is in the second position, the rotating bracket 62 is shaped to complement the second portion 50 of the fixed bracket 42 and is aligned with the second portion 50 of the fixed bracket 42. The rotating bracket 62 is substantially flush with the second portion 50 of the fixed bracket 42. The rotating bracket 62 is at least partially positioned within the receiving space 146 defined between the lip 82 of the front panel 18 and the second portion 50 of the fixed bracket 42 when the rotating bracket 62 is in the second position.

As illustrated in FIG. 10, when the rotating bracket 62 is in the second position, the first and second upper apertures 188, 190 of the rotating bracket 62 are aligned with the first and second lower apertures 158, 160 of the second portion 50 of the fixed bracket 42, respectively. The hinge fastener 162 is positioned through the second lower aperture 160 and the second upper aperture 190 to fixedly couple the rotating bracket 62 with the fixed bracket 42. When the rotating bracket 62 is fixedly coupled with the fixed bracket 42, the upper hinge pin 38 is fixed and the door 14 is hingedly coupled with the cabinet 22.

Referring again to FIGS. 1-10, the door 14 is rotatable about the upper hinge pin 38 and the lower hinge pin 118 along the vertical axis 114. The vertical axis 114 is aligned to extend through the upper and lower pin slots 26, 108 when the door 14 is coupled with the cabinet 22. In various examples, when the door 14 is coupled with the cabinet 22, the cooktop 30 may be installed and may extend over the upper hinge assembly 34 and/or the door 14. While the appliance 10, as illustrated, utilizes a vertical axis 114, it is contemplated that the upper hinge assembly 34 of the disclosure may be modified to accommodate any other hinge axis, such as a horizontal hinge axis.

The upper hinge assembly 34 is configured to accommodate vertical and/or horizontal variations of the door 14 and/or the cabinet 22 of the appliance 10. For example, the upper hinge assembly 34 may allow for manufacturing tolerances and/or may use various doors and appliances that are within the range of horizontal and vertical adjustments provided by the upper hinge assembly 34. Further, the upper hinge assembly 34 allows the gap 130 between the top panel 30 and the door 14 to be minimized without altering the appliance 10. The upper hinge assembly 34 is also self-supported by the rotating bracket 62 being fixedly coupled with both the upper hinge pin 38 and the fixed bracket 42.

According to one aspect, an appliance includes a door that is coupled with a front panel of a cabinet and defines an upper pin slot. A top panel of the cabinet is configured to extend over the door when the door is closed. An upper hinge assembly includes an upper hinge pin configured to be rotatably received by the upper pin slot of the door. A fixed bracket has a first portion coupled with the front panel of the cabinet and a second portion that extends perpendicular to the first portion. The second portion defines an opening configured to receive the upper hinge pin. A rotating bracket is coupled with the upper hinge pin and is movable between first and second positions. The rotating bracket is configured to be fixedly coupled with the second portion of the fixed bracket when the rotating bracket is in the second position.

According to another aspect, a first portion of a fixed bracket defines a receiving well that extends horizontally and has an elongated shape.

According to yet another aspect, a second portion of a fixed bracket includes an arm. The arm defines an opening configured to receive an upper hinge pin.

According to still another aspect, a second portion of a fixed bracket defines a lower aperture. A rotating bracket defines an upper aperture. The upper aperture is aligned with the lower aperture when the rotating bracket is in the second position. A fastener extends through the lower and upper apertures to couple the rotating bracket with the fixed bracket.

According to another aspect, an appliance further includes a lower hinge assembly that includes a lower hinge pin configured to be received by a lower pin slot defined by a door. The door is rotatable about an axis extending through the lower hinge pin and an upper hinge pin when a rotating bracket is coupled with a fixed bracket of the upper hinge assembly.

According to still another aspect, a front panel includes a lip that extends at least partially over a second portion of a fixed bracket. A rotating bracket is positioned between the lip and the second portion of the fixed bracket when the rotating bracket is in a second position.

According to another aspect, an appliance includes a cabinet that has a front panel and a door that has a top side and a bottom side. The top side defines an upper pin slot. A top panel is coupled with the cabinet and is configured to extend over an upper hinge assembly. The upper hinge assembly includes an upper hinge pin configured to be rotatably received by the upper pin slot of the door. A fixed bracket has a first portion that is coupled with the front panel of the cabinet and a second portion that defines an opening configured to receive the upper hinge pin. A rotating bracket is coupled with the upper hinge pin and is movable between first and second positions. The rotating bracket is aligned with and coupled with the second portion of the fixed bracket when the rotating bracket is in the second position.

According to yet another aspect, a second portion of a fixed bracket defines a lower aperture. A rotating bracket defines an upper aperture. The upper aperture is aligned with the lower aperture when the rotating bracket is in a second position.

According to another aspect, an appliance further includes a fastener that extends through a lower aperture and an upper aperture to couple a rotating bracket with a fixed bracket.

According to still other aspects, a rotating bracket is integrally formed with an upper hinge pin.

According to yet another aspect, an appliance further includes a lower hinge assembly that includes a lower hinge pin. A bottom side of a door defines a lower pin slot configured to receive the lower hinge pin.

According to another aspect, a rotating bracket is positioned between a top panel and a second portion of a fixed bracket when the rotating bracket is in a second position.

According to still another aspect, a first portion of a fixed bracket defines an elongated receiving well that has a substantially obround shape.

According to yet another aspect, a hinge assembly for an appliance includes a hinge pin configured to be rotatably received by a pin slot of a door and a fixed bracket that has a first portion and a second portion. The first portion is coupled with a cabinet. The second portion extends perpendicular to the first portion and defines an opening configured to receive the hinge pin. A rotating bracket is coupled with the hinge pin and is movable between first and second positions. The rotating bracket is configured to be fixedly coupled with the second portion of the fixed bracket when the rotating bracket is in the second position.

According to other aspects, a rotating bracket is shaped to complement a second portion of a fixed bracket. The rotating bracket is aligned with the second portion of the fixed bracket when the rotating bracket is in a second position.

According to yet another aspect, a second portion of a fixed bracket defines a first aperture and a rotating bracket defines a second aperture. The first aperture is aligned with the second aperture when the rotating bracket is in a second position.

According to still other aspects, a hinge assembly further includes a hinge fastener that extends through first and second apertures to couple a rotating bracket with a fixed bracket.

According to another aspect, a first portion of a fixed bracket defines an elongated receiving well that extends horizontally. The elongated receiving well is configured to receive a bracket fastener to couple the fixed bracket with a cabinet of an appliance.

According to yet another aspect, an elongated receiving well has a substantially obround shape.

According to still another aspect, a second portion of a fixed bracket includes an arm that defines an opening configured to receive a hinge pin.

It will be understood by one having ordinary skill in the art that construction of the described disclosure and other components is not limited to any specific material. Other exemplary embodiments of the disclosure disclosed herein may be formed from a wide variety of materials, unless described otherwise herein.

For purposes of this disclosure, the term "coupled" (in all of its forms, couple, coupling, coupled, etc.) generally means the joining of two components (electrical or mechanical) directly or indirectly to one another. Such joining may be stationary in nature or movable in nature. Such joining may be achieved with the two components (electrical or mechanical) and any additional intermediate members being integrally formed as a single unitary body with one another or with the two components. Such joining may be permanent in nature or may be removable or releasable in nature unless otherwise stated.

It is also important to note that the construction and arrangement of the elements of the disclosure as shown in the exemplary embodiments is illustrative only. Although only a few embodiments of the present innovations have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements shown as multiple parts may be integrally formed, the operation of the interfaces may be reversed or otherwise varied, the length or width of the structures and/or members or connector or other elements of the system may be varied, the nature or number of adjustment positions provided between the elements may be varied. It should be noted that the elements and/or assemblies of the system may be constructed from any of a wide variety of materials that provide sufficient strength or durability, in any of a wide variety of colors, textures, and combinations. Accordingly, all such modifications are intended to be included within the scope of the present innovations. Other substitutions, modifications, changes, and omissions may be made in the design, operating conditions, and arrangement of the desired and other exemplary embodiments without departing from the spirit of the present innovations.

It will be understood that any described processes or steps within described processes may be combined with other disclosed processes or steps to form structures within the scope of the present disclosure. The exemplary structures and processes disclosed herein are for illustrative purposes and are not to be construed as limiting.

What is claimed is:

1. An appliance comprising:

a door coupled with a front panel of a cabinet and defining an upper pin slot;

a top panel of the cabinet configured to extend over the door when the door is closed; and an upper hinge assembly including:

an upper hinge pin configured to be rotatably received by the upper pin slot of the door;

a fixed bracket having a first portion coupled with the front panel of the cabinet and a second portion extending perpendicular to the first portion, wherein the second portion includes an arm defining an opening configured to receive the upper hinge pin; and a rotating bracket coupled with the upper hinge pin and movable between first and second positions, wherein the rotating bracket is configured to be fixedly coupled with the second portion of the fixed bracket when the rotating bracket is in the second position.

2. The appliance of claim 1, wherein the first portion of the fixed bracket defines a receiving well extending horizontally and having an elongated shape.

3. The appliance of claim 1, wherein the second portion of the fixed bracket defines a lower aperture and the rotating bracket defines an upper aperture, the upper aperture aligned with the lower aperture when the rotating bracket is in the second position, and further wherein a fastener extends through the lower and upper apertures to couple the rotating bracket with the fixed bracket.

4. The appliance of claim 1, further comprising:

a lower hinge assembly including a lower hinge pin configured to be received by a lower pin slot defined by the door, wherein the door is rotatable about an axis extending through the lower and upper hinge pins when the rotating bracket is coupled with the fixed bracket of the upper hinge assembly.

5. The appliance of claim 1, wherein the front panel includes a lip extending at least partially over the second portion of the fixed bracket, and further wherein the rotating bracket is positioned between the lip and the second portion of the fixed bracket when the rotating bracket is in the second position.

6. An appliance comprising:

a cabinet having a front panel;

a door having a top side and a bottom side, the top side defining an upper pin slot; and a top panel coupled with the cabinet;

an upper hinge assembly, wherein the top panel is configured to extend over the upper hinge assembly, the upper hinge assembly including:

an upper hinge pin configured to be rotatably received by the upper pin slot of the door;

a fixed bracket having a first portion coupled with the front panel of the cabinet and a second portion defining an opening configured to receive the upper hinge pin; and a rotating bracket coupled with the upper hinge pin and movable between first and second positions, wherein the rotating bracket is aligned with and coupled with the second portion of the fixed bracket when the rotating bracket is in the second position.

7. The appliance of claim 6, wherein the second portion of the fixed bracket defines a lower aperture and the rotating bracket defines an upper aperture, and further wherein the upper aperture is aligned with the lower aperture when the rotating bracket is in the second position.

8. The appliance of claim 7, further comprising:

a fastener extending through the lower aperture and the upper aperture to couple the rotating bracket with the fixed bracket.

9. The appliance of claim 6, wherein the rotating bracket is integrally formed with the upper hinge pin.

10. The appliance of claim 6, further comprising:

a lower hinge assembly including a lower hinge pin, wherein the bottom side of the door defines a lower pin slot configured to receive the lower hinge pin.

11. The appliance of claim 6, wherein the rotating bracket is positioned between the top panel and the second portion of the fixed bracket when the rotating bracket is in the second position.

12. The appliance of claim 6, wherein the first portion of the fixed bracket defines an elongated receiving well having a substantially obround shape.

13. A hinge assembly for an appliance, comprising:

a hinge pin configured to be rotatably received by a pin slot of a door;

a fixed bracket having a first portion and a second portion, wherein the first portion is configured to be coupled with a cabinet, and further wherein the second portion extends perpendicular to the first portion and defines an opening configured to receive the hinge pin, and further wherein the first portion of the fixed bracket defines an elongated receiving well extending horizontally and configured to receive a bracket fastener to couple the fixed bracket with the cabinet of said appliance;

a rotating bracket coupled with the hinge pin and movable between first and second positions, wherein the rotating bracket is configured to be fixedly coupled with the second portion of the fixed bracket when the rotating bracket is in the second position.

14. The hinge assembly of claim 13, wherein the rotating bracket is shaped to complement the second portion of the fixed bracket and is aligned with the second portion of the fixed bracket when the rotating bracket is in the second position.

15. The hinge assembly of claim 13, wherein the second portion of the fixed bracket defines a first aperture and the rotating bracket defines a second aperture, the first aperture aligned with the second aperture when the rotating bracket is in the second position.

16. The hinge assembly of claim 15, further comprising:

a hinge fastener extending through the first and second apertures to couple the rotating bracket with the fixed bracket.

17. The hinge assembly of claim 13, wherein the elongated receiving well has a substantially obround shape.

18. The hinge assembly of claim 13, wherein the second portion of the fixed bracket includes an arm defining the opening configured to receive the hinge pin.

* * * * *